United States Patent [19]

Engel et al.

[11] 4,415,293

[45] Nov. 15, 1983

[54] OFFSHORE PLATFORM FREE OF MARINE GROWTH AND METHOD OF REDUCING PLATFORM LOADING AND OVERTURN

[75] Inventors: Robert F. Engel, Kingwood; Thomas E. Long, Houston; Ralph M. Warrington, Humble, all of Tex.

[73] Assignee: Shell Oil Company, Houston, Tex.

[21] Appl. No.: 365,223

[22] Filed: Apr. 5, 1982

[51] Int. Cl.[3] ..... E02B 17/00

[52] U.S. Cl. ..... 405/216; 204/197; 405/211

[58] Field of Search ..... 405/195, 211, 216; 204/196, 197; 114/222

[56] References Cited

U.S. PATENT DOCUMENTS

| | | | |
|---|---|---|---|
| 2,791,096 | 5/1957 | Morton et al. | 405/216 |
| 2,870,079 | 1/1959 | McCall | 204/197 |
| 3,047,478 | 7/1962 | Marsh et al. | 204/197 X |
| 3,360,452 | 12/1967 | McNulty | 204/197 |
| 3,620,943 | 11/1971 | White | 204/197 X |
| 3,769,521 | 10/1973 | Caldwell et al. | 405/211 X |
| 3,992,272 | 11/1976 | Maxson et al. | 204/197 X |
| 4,056,446 | 11/1977 | Vennett | 204/197 X |
| 4,089,767 | 5/1978 | Sabins | 405/211 X |
| 4,211,503 | 7/1980 | Peterson et al. | 405/216 |
| 4,285,615 | 8/1981 | Radd | 405/211 |

OTHER PUBLICATIONS

Research Disclosure Aug. 1978—#172118—Protection of articles from marine corrosion—Disclosed by Inco Europe Limited.

*Primary Examiner*—Dennis L. Taylor

[57] ABSTRACT

Method of prevent marine growth on the shallow water portions of platform legs by applying a polymer coating to the legs and covering the polymer with a copper-nickel alloy anti-fouling covering.

12 Claims, 6 Drawing Figures

FIG. 2
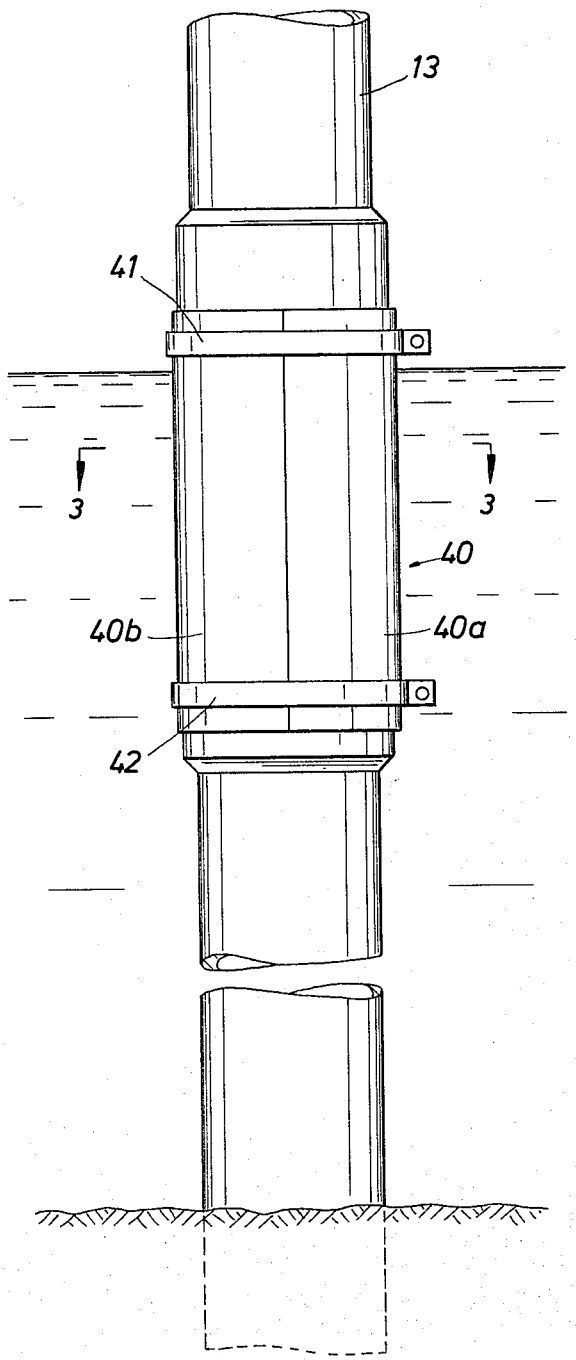
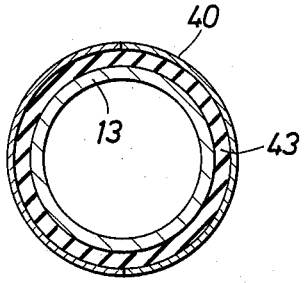
FIG. 3
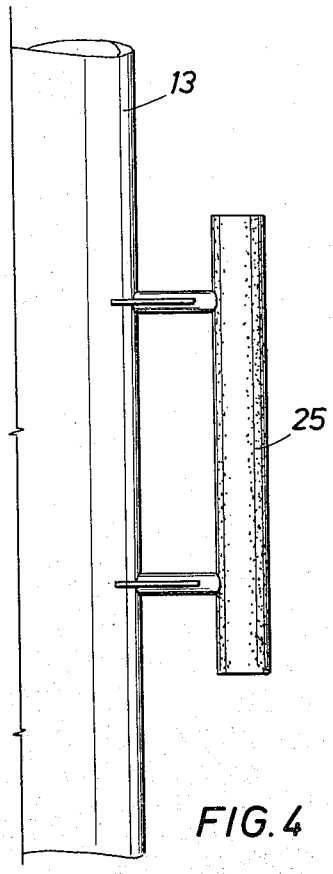
FIG. 4

OFFSHORE PLATFORM FREE OF MARINE GROWTH AND METHOD OF REDUCING PLATFORM LOADING AND OVERTURN

BACKGROUND OF THE INVENTION

This invention relates to the improved construction of an offshore platform of the type used in the production of offshore oil and gas wells, which platform is provided with means for maintaining it free of marine growth so as to reduce the load on the platform and to stabilize it against horizontal overturn forces due to ocean currents and wave action and to reduce inertia loads during movements caused by earthquakes.

Present day offshore platforms used in the oil and gas industry are often formed of large diameter pipe elements in the form of four or more vertical or slanting legs interconnected or reinforced by cross-bracing tubular members. Such bottom-supported platforms have been used in waters up to 1025 feet deep. The deep water platforms may have more legs which may be tapered. For example, one deepwater platform off the California coast has eight legs that are made of 72 inch diameter pipe at the ocean floor and taper upwardly to 48 inch diameter pipe at sea level. Cross-bracing members are mostly 36 or 42 inches in diameter. In addition, the platform is provided with sixty 24 inch diameter vertical pipes, risers or well conductors which are grouped near the center of the platform and through which individual wells are drilled. Further, the platform supports vertical pipe risers through which oil and gas may be separately pumped down to an ocean floor pipeline and thence to shore.

All of the pipes or tubular members associated with oil and gas drilling and/or production offshore platforms, whether of the fixed or tension leg or floating types, are subject to the accumulation of marine-fouling growth to varying degrees to a depth of sixty feet or so in sea water and in the proper environment.

The term marine-fouling as used herein is also referred to as bio-fouling, organismic encrustation, or biotic encrustation and may take the form of clumps or colonies of barnacles, mussel, rock jingle, etc. Marine-fouling grows in the form of a sheath or coating of heavy bioencrustations which add substantial mass to tubular platform or other members and increase the effective diameter or volume of the members that are subjected to wave and/or earthquake forces.

It is known to plate the bottom of wooden ship hulls with copper to prevent the growth of barnacles. Steel ship hulls have been protected for short periods by painting them with anti-fouling paints containing, for example, copper in the form of cuprous oxide as the toxic anti-fouling material. Further, U.S. Pat. No. 3,303,118 teaches employing an electrode system immersed in sea water on the metal structure to be protected. Sufficient voltage is applied to both electrode components to produce a voltage differential high enough to provide a flow of electrolytic decomposition products toxic to marine organisms, for example, the decomposition products sodium hypochlorite, chlorine and oxygen.

It is further known to pass a direct current continuously between a ship's hull and copper electrodes carried outwardly thereof so that compounds given off by the anodes will prevent the growth of molluses and weeds, as taught in British Patent Specification No. 754,812.

Additionally, it has been shown in U.S. Pat. Nos. 2,791,096 and 4,211,503 to protect the splash zone of offshore steel tubular elements by joining to a steel tubular element, and in contact therewith, a corrosion resistant, non-ferrous metal covering sheath, for example, one made of a copper-nickel or a nickel-copper alloy. These patents are concerned with preventing corrosion due to splashing sea at a point above the normal water level. None of the above patents are concerned with providing a tough, long-lasting apparatus adapted to be arranged on an offshore steel platform or on the members thereof below the water level in a manner such that the apparatus does not act as a sacrificial anode or a cathode, while preventing the accumulation of heavy marine growth on the sections of the platform protected by the apparatus.

SUMMARY OF THE INVENTION

It is an object of the present invention to apply to structural members of an offshore steel platform a surrounding sheath of a non-ferrous material which is secured to a structural member in an electrically-insulated manner so that the sheath does not cause corrosion of the structural member. The sheath preferably surrounds the structural member and preferably extends from a point adjacent the water level at mean low tide and thence downwardly for a distance sufficient to cover that portion the outer surface area of the structural member which may be subject to at least the major portion of heavy fouling marine growth. The sheath includes, carries, or forms a source of a biocide or marine growth-inhibiting agent, alone or when reacted with sea water, in an amount sufficient to eliminate substantially in sea water the growth and attachment of heavy marine growth. Sheaths made of a copper-nickel alloy, with a high amount of copper in them, have proved to be excellent for preventing marine growth on a steel members of a platform in an offshore location.

Sheets of copper may be used to form sheaths of the present invention, but it is preferred that an alloy of copper be used to form a tougher covering for a structural member.

The accumulation of heavy marine growth on steel elements or pipe in sea water varies considerably around the world and is not a problem in many area. Light, temperature, and the presence of nutrients in the sea water are factors which effect the growth of marine encrustations. A survey showed that the waters for several miles off the coast of Southern California are especially rich in nutrients and form a high growth bio-fouling area.

In this area, growth of marine encrustations of 6 inches or more a year is not uncommon on offshore steel platform legs, pipe risers and well conductors. Maximum thickness of 24 inches was observed on the inspected platforms. Thicknesses of marine encrustations as great as 36 to 48 inches have been previously reported by others.

In one test area, a pipe having a bare metal section and a section coated with a $\frac{1}{2}$ inch elastomeric polymeric sheath showed an accumulation of 3 to 4 inches of a marine growth sheath over both sections after 237 days exposure in sea water. The rate of marine growth or fouling on a new pipe riser, well conductor or platform structural element in this area is 3 inches in thickness within one year; 3 to 6 inches for the second year with stabilized maximum growth being reached during the third year. The average stabilized marine growth on a vertical steel element in 3 years would be 8 to 12 inches thick from 3 feet above the water surface to 35 feet below. Below that depth the average growth would be less than 6 inches and would diminish with depth while the marine organisms making up the growth may be of a different class or composition. Little marine growth occurs on steel members in this area 50 to 60 feet below the water surface. Divers with high pressure water hoses can be used to remove marine growth from structural element or well conductors. After removal, regrowth rates of marine encrustations are higher (e.g., 6 inches per year) than the original rate of growth on a newly-installed steel elements. Hence, yearly removal of the marine growth would be necessary to keep the sheath of marine growth under a 6 inch thickness.

It is a main object of the present invention to prevent or minimize decrease in the calculated or design fatigue life of a steel platform or the structural elements thereof, which platform is positioned at an offshore location where it is subjected to lateral wave forces. Fatigue life of an offshore platform and its component parts is predominately related to the square of the diameter of its component parts via the inertial component of wave loading from small waves. Considering as little as a 6 inch radial marine growth on a 24 inch diameter steel structural member or well conductor, the unit volume thereof goes up by a factor of 2.25. The effective diameter of the member subject to wave forces has a very important effect on fatigue life as in this example where a reduction in force level by a factor of 2 yields approximately a 20× increase in fatigue life.

Thus, it may be seen that by mounting an electrically-insulated copper-nickel alloy sheath on the structural elements of an offshore steel platform from about the water line down about, say, 30 feet, the major portion of marine fouling growth will be eliminated and so as to increase the fatigue life of the structural elements up to 20 times. The use of sheathed structural elements of a platform in accordance with the present invention decreases the projected wave force area near the waterline below that of a platform with marine growth on it. Since fatigue damage is exponentially related to force level, and most damage is done by small, frequently-occurring waves, there will be a significantly higher fatique life for a platform built in accordance with the present invention.

A further object of the present invention is to provide a marine platform on which marine life or encrustations cannot grow thereby obviating the cleaning of the platform.

BRIEF DESCRIPTION OF THE DRAWING

These and other objects and advantages of this invention will become apparent from the description hereinafter following and the drawing forming a part hereof, in which:

FIG. 2 is a longitudinal view illustrating a marine growth-inhibiting sheath of the present invention mounted on a section of a structural member of a platform, FIG. 3 is a cross-sectional view of a marine growth-inhibiting sheath taken along the line 3—3 of FIG. 2, FIG. 4 is a schematic view of one type of an anode mounted on a structural member of a platform.

Referring to FIG. 1 of the drawing, an offshore platform generally represented by numeral 10 is shown as being positioned on the ocean floor 11 and extending upwardly above the waterline 12. The platform 10 comprises a series of upwardly extending legs 13 connected together by suitable cross-bracing 14 and provided with other reinforcing members 15. A platform deck 17 is mounted on and secured to the upper end of the legs 13 or vertical extensions 18 of the legs 13. Any suitable configuration of platform legs may be employed and may contain from 3 to 24 or more legs.

In waters up to several hundred feet deep, a platform 10 is generally fabricated as a unit and is then floated or barged out to the selected offshore location where it is off-loaded into the water, uprighted and then slowly sunk to its selected position on the ocean floor. Thereafter, tubular piles are driven down through the legs into the ocean floor 11. The piles 20 may be secured to the ocean floor by means of grout 21. It is to be understood that other types of anchoring piles may be employed, such, for example, as skirt piles. Since the precise configuration of the platform 10 and the pile anchoring means therefor form no part of the present invention and are well known to the art, they will not be further described here.

Figures 5, 6:
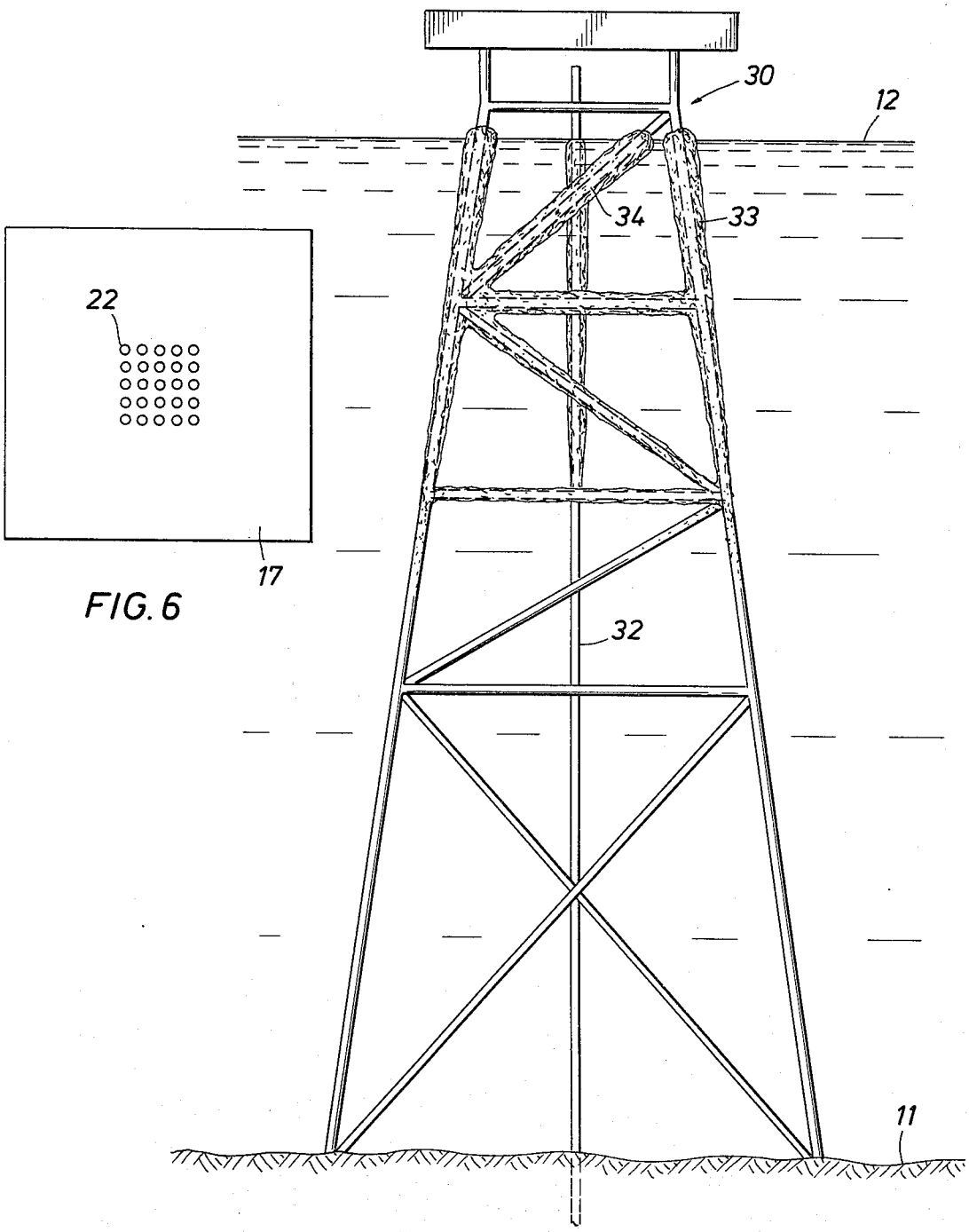
FIG. 5 is a schematic view of a steel platform positioned on the ocean floor at an offshore location wherein marine growth or encrustations have formed and built up on the outer surface of the platform from about the water level down to 50 or 60 feet therebelow.
FIG. 6 is a plan view of the deck portion of platform of FIG. 5.

In FIG. 6 of the drawing, the plan view of the deck 17 of the platform 10 is shown as being provided with 25 conductor openings 22 through which well conductors may be inserted, driven into the ocean floor, and through which an oil or gas well is drilled. Twenty-five openings are shown in the deck illustrated in FIG. 6 although platforms have been used having openings for up to about one hundred well conductors.

Figure 1:
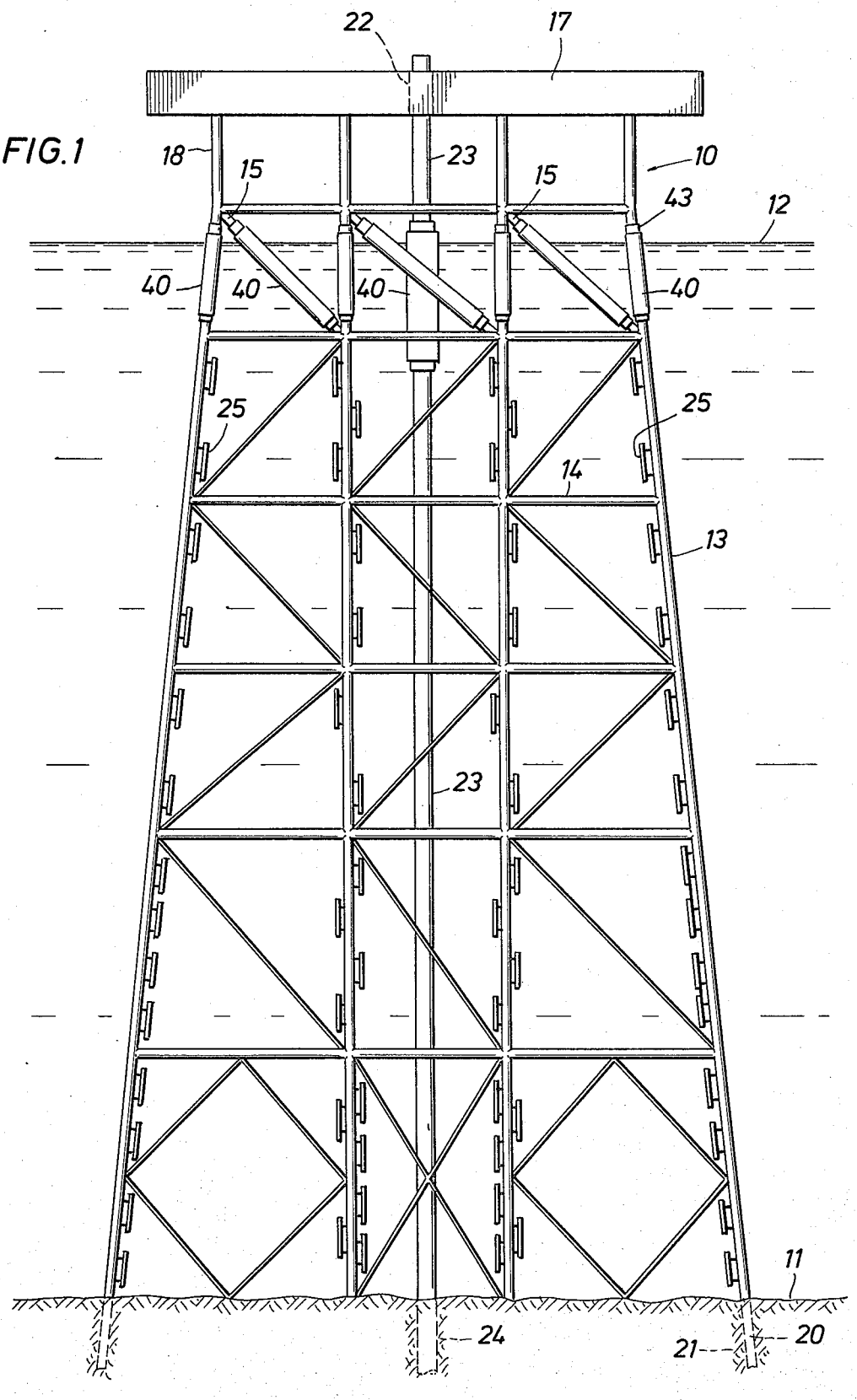
FIG. 1 is a schematic view of a steel platform in accordance with the present invention which is positioned at an offshore location.

In FIG. 1, a single well conductor 23 is shown as having been inserted through the deck 17 and down through the platform 10, thence to be driven in the ocean floor 11.

In order to protect the present offshore platform 10 from corrosion in sea water, the structural members of the platform are provided with a cathodic protection system which comprises fixedly securing to a plurality of the structural members a number of sacrificial anodes 25 which are preferably made of aluminum or aluminum alloy, in a manner well known to the art.

Corrosion in sea water is an electrochemical process. During the chemical reaction of metals with the environment to form corrosion products (such as rust on steel), metallic atoms give up one or more electrons to become positively charged ions and oxygen and water combine with the electrons to form negatively charged ions. The reactions occur at rates which result in no charge build-up. All the electrons given up by metal atoms must be consumed by another reaction.

Cathodic protection is a process which prevents the anodic corrosion reaction by creating an electric field at the surface of the metal so that current flows into the metal. This prevents the formation of metal ions by setting up a potential gradient at the surface which opposes the electric current which arises from the flow of electrically charged ions away from the surface as the product of corrosion. The electric field must be of adequate strength to ensure that metal ions are fully prevented from escaping.

A source of the electric field which opposes the corrosion reaction may be a current supplied from the preferential corrosion of a metal anode with different electrochemical properties in the environment, and which has a stronger anodic reaction with the environment than does the offshore structure. Thus, current flows to the structure from the additional anode, which itself progressively corrodes in preference to the structure. This technique is known as sacrificial anode cathodic protection. This method is used extensively for the protection of offshore platforms, drilling rigs, submarine pipelines, etc.

Cathodic protection does not prevent the cathodic reaction taking place on the structure surface and alkaline conditions occur as a result of the oxygen reduction reaction. This gives a rise of pH close to the surface which in turn alters the solubility of the calcium and magnesium salts in the sea water. A chalk-like product can be formed dependent on the environmental conditions and the current density applied. The chalk scale may be a dense hard film-like eggshell, or a soft friable and porous scale which is only poorly adherent. The presence of a scale is often beneficial since once it has been formed it contributes to lowering of the current density to maintain protection. The scale may form in only a few hours, or it may take months to form depending on local conditions.

When a sacrificial system is chosen, the weight of material required to provide the protection current for the protected lifetime of the structure is calculated from a knowledge of the current demand and also the specific electrochemical properties of the anode alloys.

The calculated weight of anode alloy cannot be installed all in one piece but must be distributed over the structure in the form of smaller anodes to ensure uniform distribution of current. In order to select the best size and shape of anode, the total current demand of the structure both at the beginning and end of its life must be considered. The anode must deliver adequate current to polarise the structure and build up cathodic chalks, but also must be capable of delivering the required mean current for the structure when 90% consumed.

Thus it will be seen in FIG. 1 that a multiplicity of anodes 25 are arranged on the various structural members of the platform. These anodes are generally attached to the platform before the platform is lowered to the ocean floor. Generally, the well conductor pipes 23 are not provided with anodes 25 as the conductors are lowered through the deck 17 and driven into the ocean floor 11 after the platform is in position. It has been found that by installing numerous anodes 25 on the structural elements of the platform 10 in the vicinity of the well conductors 23 that the conductors 23 are adequately protected against electrolytic corrosion in the sea water since they are in contact with or electrically connected to the platform.

Although no sacrificial anodes 25 are shown on the offshore platform illustrated in FIG. 5, it can be assumed that this platform 30 would have anodes secured to the structural members thereof in a manner taught with regard to the platform 10 of FIG. 1. The upper ends of the legs 31 in the well conductor 32, as well as cross-bracing members 34, are shown in FIG. 5 as being covered with marine growth 33. This marine growth or encrustation may take the form of clumps or colonies of barnacles, mussel, rock jingle, etc. Marine-fouling growth grows in the form of a sheath or coating of heavy bioencrustations which adds substantial mass and volume to the structural elements of the platform and increases the effective diameter that is subjected to lateral forces of wave action. acting to overturn the platform. As previously described hereinabove, in certain areas of the world a six ink thick sheath of marine growth may form in a year and ultimately grow to a radial thickness of 24 inches or more.

In accordance with the present invention, a structural element of the platform 10, such as a leg 13 or well conductor 23 (FIG. 1) is illustrated in FIG. 2 as being provided near its upper end with a protective sheath 40 which is illustrated as being made up of two half cylinder portions, 40*a* and 40*b*, which may be held together around the leg 13 by means of clamps 41 and 42 or glued or vulcanized by heat, and which are preferably made of a noncorrosive material. The sheath 40 is of a diameter greater than the leg 13 and is spaced therefrom by suitable insulating connector means 43 which must be made of electrically-insulating material, as is described with regard to FIG. 3.

The sheath 40 in FIGS. 2 and 3 is illustrated as a thin-walled sheet of a non-ferrous material arranged along the leg 13 and fixedly positioned adjacent thereto in a spaced-apart relationship. Each sheath 40 extends along the leg 13 and each selected structural element over a distance which is subject to the accumulation of at least the major portion of fouling marine growth. In the worst marine growth areas, the sheath may extend from about 3 feet above the mean low tide water level to about 50 or 60 feet below. In other areas, it is sufficient for the sheath to extend from the water line at mean low tide down to about 15 feet below this point. In some circumstances, such as in shallow water areas, the sheath may extend from the mean low tide water level down to the ocean floor. The sheath 40 includes a substance for generating in sea water a source of marine growth-inhibiting agent in an amount sufficient, when positioned in sea water, to eliminate substantially most if not all the marine growth and to prevent its attachment to the outer surface of the sheath and to that portion of the structural member adjacent the sheath.

The thin-walled sheath of non-ferrous material forming the sheath may be copper but the low strength characteristics and poor handling qualities of this material for offshore installations places it low on the list of materials to work with. A copper-nickel alloy with about at least 70% copper in it is suitable, while an alloy having about 90% copper and 10% nickel in it is preferred.

The action by which the sheath prevents marine growth is not entirely understood but it is believed that the copper ions in a predominantly copper alloy sheath generate in the sea water a cuprous hydroxychloride compound coating on the copper alloy sheath which inhibits the attachment of free-swimming marine larvae. It was found that the above marine growth preventing characteristics of the copper disappeared when the copper alloy sheath 40 was directly mounted on a steel structural member of the platform which was provided with a cathodic protection system in the form of anodes 25 (FIG. 4). Thus, it was found necessary to electrically insulate the sheath 40 from the leg 13. This is most easily done by filling the space between the sheath 40 and the smaller-diameter leg 13 with a non-conductive material of any suitable type. This could be done most easily by wrapping portions of the legs with rubber, synthetic rubber, or any suitable elastomeric polymeric material which could be bonded, vulcanized or polymerized to the outer surface of the legs either by the application of a bonding material or heat or both, or with heat and pressure. Pipe coatings of the above type are well known to the art and are described in detail in U.S. Pat. No. 3,417,569 which issued Dec. 24, 1968 and is entitled Protective Coating and Method. While the coating is described in that patent as being protective against splash zone corrosion, no protection against marine growth below the water level was provided.

It may be seen that if an insulating material 43 is used around the leg 13 (FIG. 3), the insulating material 43 may be bonded to both the leg 13 and the sheath 40 to serve as connector means for holding the sheath on the leg.

While a tubular sheath 40 could be slipped over the end of a structural element to its selected position thereon during the construction of the platform, it has been found that the sheath 40 can be more easily mounted on a leg 13 if two half cyclinders 40*a* and 40*b* are mounted on either side of the leg at a point covered by insulating material 43. Either one or both sides of the insulating material 43 can be coated with a suitable bonding compound and the sections 40*a* and 40*b* can be temporarily clamped in place, as by means of clamps 41 and 42 shown in FIG. 2. Depending upon the type of insulating material and bonding compounds used, the assembled section or element, if desired, may be treated with heat or with heat and pressure to achieve the necessary bonding. After bonding, the clamps may be removed. It is realized that other connecting means may be employed such as by the use of the clamps 41 and 42 of FIG. 2 which could be used to hold the sheath against an insulating material wrapped without necessarily bonding one to the other.

Referring to FIG. 1 of the drawing, it is to be understood that the benefits of the present invention may be realized without providing each structural element of the platform near the water surface with a sheath element containing a source of marine growth-inhibiting agent. Thus it is not necessary that each and every leg 13, cross-bracing member 15, and well conductor 23 be provided with marine growth preventing means in the manner taught. The main object of the invention is to provide a means for reducing substantially the great mass of the marine encrustations on a platform and, more importantly, to reduce the area or volume of encrustations which build up on the structural members of the platform and which are subjected to wave or earthquake action. This mass and volume of marine encrustations near the surface increases the overturning moment lateral forces of a platform as well as weakening the platform by increasing the fatigue effects on the various structural members of the platform, both those to which marine encrustations attach themselves and those lower down on the platform.

By making use of the marine-inhibiting sheath elements of the present invention, the depth to which the anchoring piles 20 (FIG. 1) are driven and the length of the pile used may be reduced. With less overturn moment to contend with, the resistance of shorter piles would be adequate to maintain the platform in place if marine growth is eliminated near the waterline. Thus, there is a saving in the amount of steel used in the piles 20 and also a saving in the time it takes to drive the piles into place. With less wave loading at the waterline, there is less fatigue on the joints connecting the structural members of the platform. Increased platform reliability is realized and overloads caused by wave action, currents and/or earthquakes are reduced.

In the event that the platform, as illustrated in FIG. 1, is provided with 25 well conductor pipes 23 through the openings 22 (FIG. 6), then it may be readily seen that far more marine growth will accumulate on 25 well conductors which may be 24 inches in diameter, than would accumulate on 8 platform legs 13 which may be 36 inches in diameter near the waterline. In such a platform installation, putting the marine-growth-inhibiting sheaths on the well conductors without putting them on any of the legs or cross-bracing members. On the other hand, if the platform were to have only 1 or 2 well conductors extending into the ocean floor, far greater benefits would be realized by installing marine-growth-inhibiting sheaths on the legs of the platform rather than on the well conductors.

We claim as our invention:

1. An offshore platform having a multileg steel structure adapted to extend from a point above the surface of a body of water to a substantial distance therebelow, said platform substructure comprising a plurality of upwardly-extending tubular members in the form of legs to support a platform deck thereon, each of said tubular members traversing the surface of a body of water, a plurality of additional tubular members in the form of bracing and well conductors connected to said platform, a sheath element concentrically mounted to surround each of a selected number of the tubular members of said substructure, each sheath element being in concentric spaced relation therewith extending from a point about adjacent the surface of the water downwardly for a distance sufficient to cover the area subject to the accumulation of at least the major portion of fouling marine growth, said sheath element including a substance for generating in sea water a source of marine growth-inhibiting agent in an amount sufficient, when positioned in sea water, to eliminate substantially the growth and attachment of marine growth on a tubular member covered with said sheath element, and insulating connector means fixedly securing said sheath element to said tubular member for substantially electrically insulating said sheath element from said tubular member.

2. The apparatus of claim 1 wherein the sheath element covers that area of a tubular member subject to the accumulation of the major portion of marine growth, said area extending from about two feet above the mean low water level to about 20 feet below said water level.

3. The apparatus of claim 1 wherein the electrically-insulating connector means fills the sapce between the concentrically-spaced element and the tubular element.

4. The apparatus of claim 3 wherein said electrically-insulating connector means comprises a layer of insulating material bonded to the inner surface of the sheath element and to the outer surface of the tubular element.

5. The apparatus of claim 1 including a sheath element concentrically mounted to surround substantially the entire length of each of said cross-bracing members connected to the tubular elements of said substructure at water depths where the major portion of marine growth would occur, said sheath element forming a marine growth-inhibiting surface, and electrically-insulating connector means fixedly securing each sheath member to an adjacent concentric cross-bracing member.

6. The apparatus of claim 4 wherein the electrically-insulating connector means comprises a layer of elastomeric material bonded by heat treatment between the sheath element and the tubular, to the adjacent surfaces thereof.

7. The apparatus of claim 1 wherein the sheath element is made of a metal alloy having at least 70% by weight of copper in its composition adapted to form in sea water a copper-containing biocide compound.

8. The apparatus of claim 7 wherein the sheath element is made up of two halves of a longitudinally-split metal alloy cylinder in at least two arcuate sections adapted to form a substantially continuous sheath in a spaced-apart position on opposite sides of the portion of a tubular element to be protected against marine growth, and said insulating connector means in the form of an elastomeric polymer floodtight layer interposed between said tubular element and said sheath element halves and bonded thereto.

9. Method of maintaining substantially constant, to ocean currents and wave forces, the projected area and volume of a steel sub-structure of an offshore platform having a plurality of tubular members adapted to extend downwardly into a body of water from above the surface thereof, said method comprising the steps of:

substantially surrounding a selected number of said tubular members of said platform substructure with aquatic biocide in the form of a biocide-generating sheath of metal extending from about the waterline on the tubular member downwardly a distance sufficient to protect the tubular member from the formation of fouling marine organisms, and electrically-insulating said aquatic biocide-generating sheath from said tubular member to maintain said generation of aquatic biocide in active form adjacent said sheath.

10. The method of claim 9 including the step of bonding in a fluidtight and electrically-insulated manner each of said biocide-generating sheaths to the tubular memeber it surrounds.

11. The method of claim 9 including the step of providing a source of copper in said biocide-generating metal sheath to generate copper compounds which prevent fouling marine growth from attachment to the structure.

12. The method of claim 9 including the steps of preventing substantially all electrolytic corrosion of the steel substructure by installing a plurality of sacrificial anodes at selected spaced intervals on the legs of the substructure, and electrically connecting each of said anodes to a leg.

* * * * *